US005696332A

United States Patent [19]

Yang

[11] Patent Number: 5,696,332

[45] Date of Patent: Dec. 9, 1997

[54] MUSIC BOX MECHANISM

[76] Inventor: Chin-Long Yang, No. 48, Lane 502, Wen Shyan Rd.,, Tainan City, Taiwan

[21] Appl. No.: 621,598

[22] Filed: Mar. 26, 1996

[51] Int. Cl.[6] ..... G10F 1/06

[52] U.S. Cl. ..... 84/95.2; 84/602; 446/298

[58] Field of Search ..... 84/95.1, 95.2, 84/94.1, 94.2, 602, 600, 601; 446/298, 297

[56] References Cited

U.S. PATENT DOCUMENTS 5,567,892 10/1996 Huang ..... 84/95.2

*Primary Examiner*—Cassandra C. Spyrou

*Attorney, Agent, or Firm*—Morton J. Rosenberg; David I. Klein

[57] ABSTRACT

An improved music box mechanism is provided which includes a stock, a control circuit board, a locating cap piece, a ring shell and a lid. The control circuit board is connected to an inductor to make the device replay a musical tune at a constant speed, and is capable of playing music continuously.

1 Claim, 3 Drawing Sheets

MUSIC BOX MECHANISM

BACKGROUND OF THE INVENTION

1. Field of the Invention

The present invention relates to a music box mechanism, and more particularly to a music box having employed therein an inductor that is coordinated with an electric circuit to initiate its operation.

2. Prior Art

In conventional music boxes, most use mechanical components, such as a spiral power spring that drives a cylinder having many projections. Those projections on the rolling cylinder can knock a reed to produce a sound. If the rolling movement is continued, these different notes produce a musical tune. The advantage of a conventional music box is to provide a simple structure installation, but there exists some shortcomings as follows:

1. Once the spring is wound up, the music can not be stopped till the spring runs out.

2. On the surface of the cylinder, only one tune or part of a tune can be contained. In such case, the music may be dull and is less attractive to the listener, and the listener will be dissatisfied.

3. Due to the way in which the spiral power spring works, nonlinearly, the music is played fast during the time the spring is more tightly wound, and slow when the spring is less tightly wound. In that case, the music sounds weird.

SUMMARY OF THE INVENTION

According to the above-mentioned shortcomings of conventional music boxes, an object of the present invention is to provide music box that can play more than one tune at a constant speed, with the music being replayed and stopped at any desired time. In order to meet these objectives, the present invention employs an electric circuit to drive a motor so as to control the movement of the motor, and an inductor which responds to a moving object triggers a music IC circuit to smoothly play a prestored tune.

DESCRIPTION OF THE PREFERRED EMBODIMENT

Figure 1:
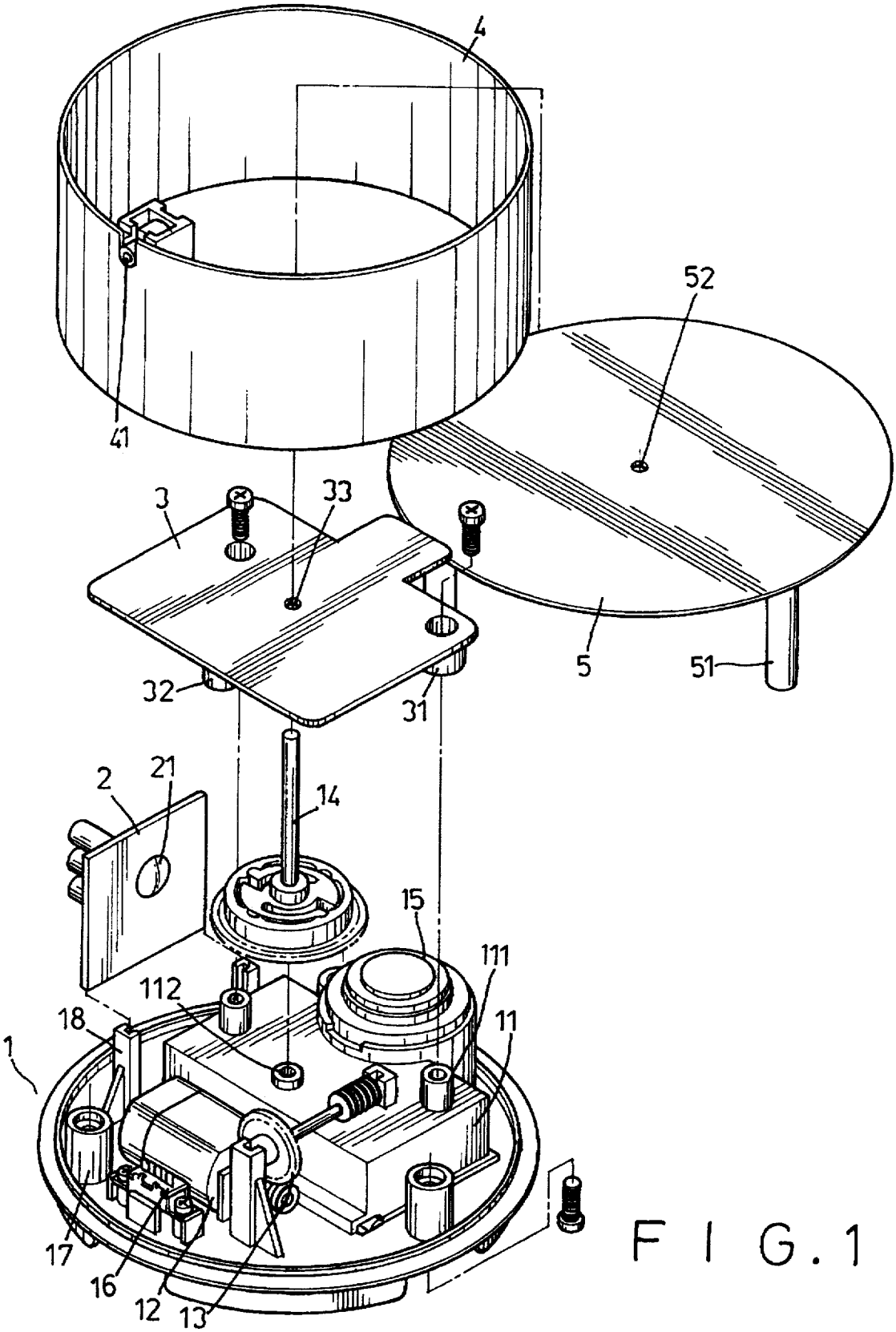
FIG. 1 is an exploded perspective view of the present invention.

Referring to FIG. 1, the present invention is shown to comprise a stock 1, a control circuit board 2, a locating cap piece 3, a ring shell 4 and a lid 5.

The stock 1 is a disc shaped base having a battery compartment 11 on a top portion with two screw bases 111 and a bossing 112 on the top surface of the battery compartment 11. A motor 12 secured on the stock 1 connects to a shaft 14 through cluster gears 13. The shaft 14 plugs into the bossing 112 vertically. The stock 1 supports a horn 15 on one side thereof, and a switch 16 mounted on an opposing side for switching the box on or off from the bottom portion. Three screw bases 17 are spaced along the edge of the stock 1. Two racks 18 are formed on opposing sides of the stock 1 for holding the control circuit board 2 thereon.

The control circuit board 2 is employed in controlling every movement of the music box. A music IC 21 having several complete musical tunes prestored therein is disposed on control circuit board 2. The control circuit board 2 connects with the battery compartment 11, the motor 12, the horn 15, the switch 16 and an inductor 41 by wires.

The locating cap piece 3 supports the shaft 14. The locating cap piece 3 is fastened on the screw bases 111 of the top side of the battery compartment 11 with screws passing through screw guide bases 31 corresponding to the screw bases 111. The locating cap piece secures motor 12 with a pin rod 32 pressing down on the top of the motor 12. A through hole 33 formed through the center of the locating cap piece 3 is provided for passage therethrough of the shaft 14.

The ring shell 4 is a cylindrical wall corresponding to the diameter of the stock 1. The inductor 41 is secured to the ring shell 4, adjacent the top edge thereof.

The lid 5 is a disk covering the ring shell 4. From the bottom side of the disk, corresponding to the screw bases 17 on the stock 1, several screw guide bases 51 extend downwardly therefrom. A through hole 52 is formed through the center portion of the lid 5.

Figure 2:
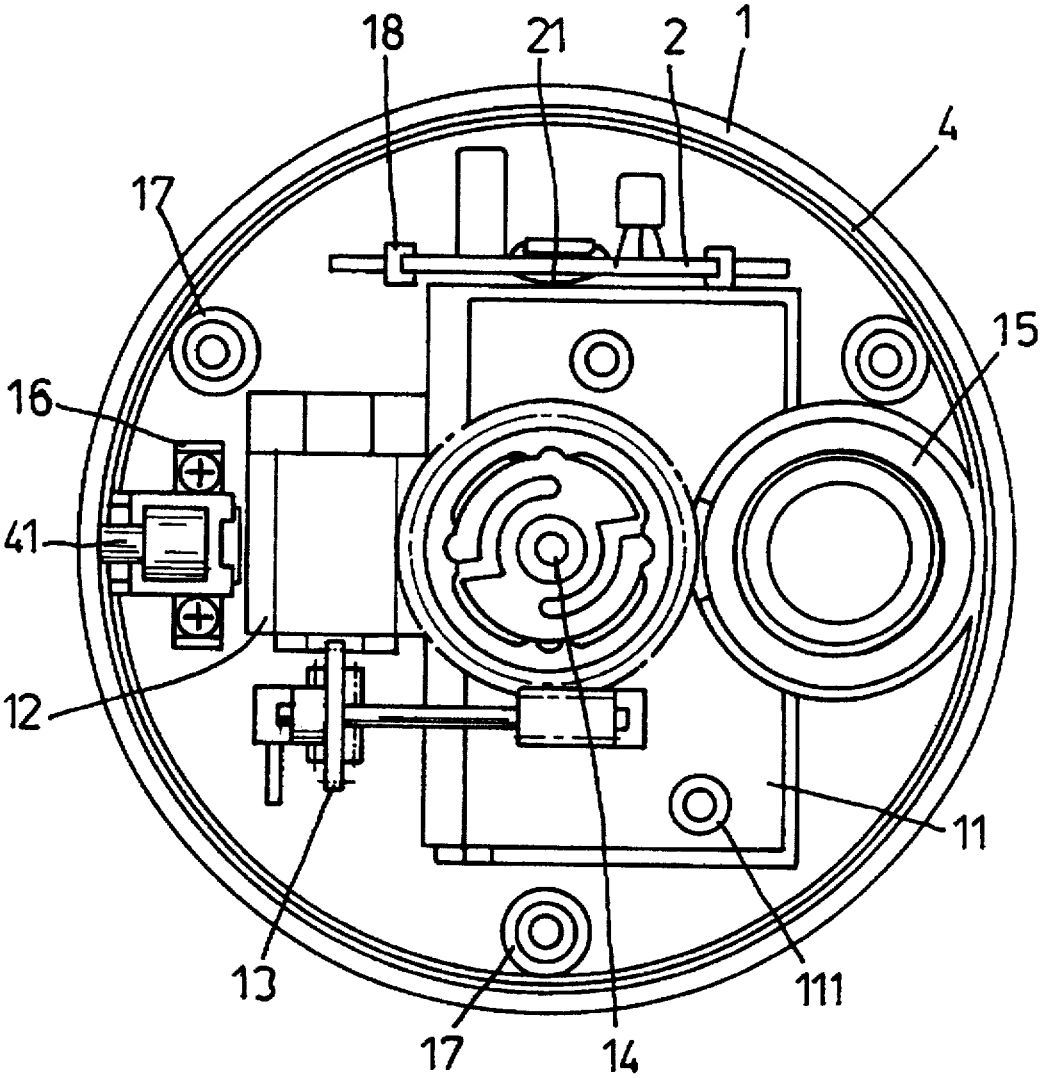
FIG. 2 is a plan view of the present invention.

Next referring to FIG. 1 and FIG. 2, in assembling the box, the lower end of the shaft 14 is inserted into the bossing 112 on the top side of the battery compartment 11. The locating cap piece 3 is put on, so that the other end of the shaft 14 passes through the hole 33, with the screw guide bases 31 coming into contact with the screw bases 111 on the top of battery compartment 11, and the pin rod 32 touching the top of the motor 12. The locating cap piece 3 covers all of the parts and secures both the motor 12 and the cluster gears 13 on the stock 1. Some screws passing through the holes of the screw guide rods 31 fasten the locating cap piece 3 on the screw bases on the top of the battery compartment 11. The control circuit board 2 is inserted between the opposing racks 18, the ring shell 4 is mounted on the stock 1, as an outer side wall. Then, the lid 5 is placed onto the rim of the ring shell 4, as the through hole 52 is sleeved over the upper end of the shaft 14 and the screw guide bases 51 are brought into contact with the tops of the screw bases 17 of the stock 1. Lastly, the screws passing through the guide holes of the screw guide bases 51 bolt the lid 5 onto the stock 1.

Figure 3:
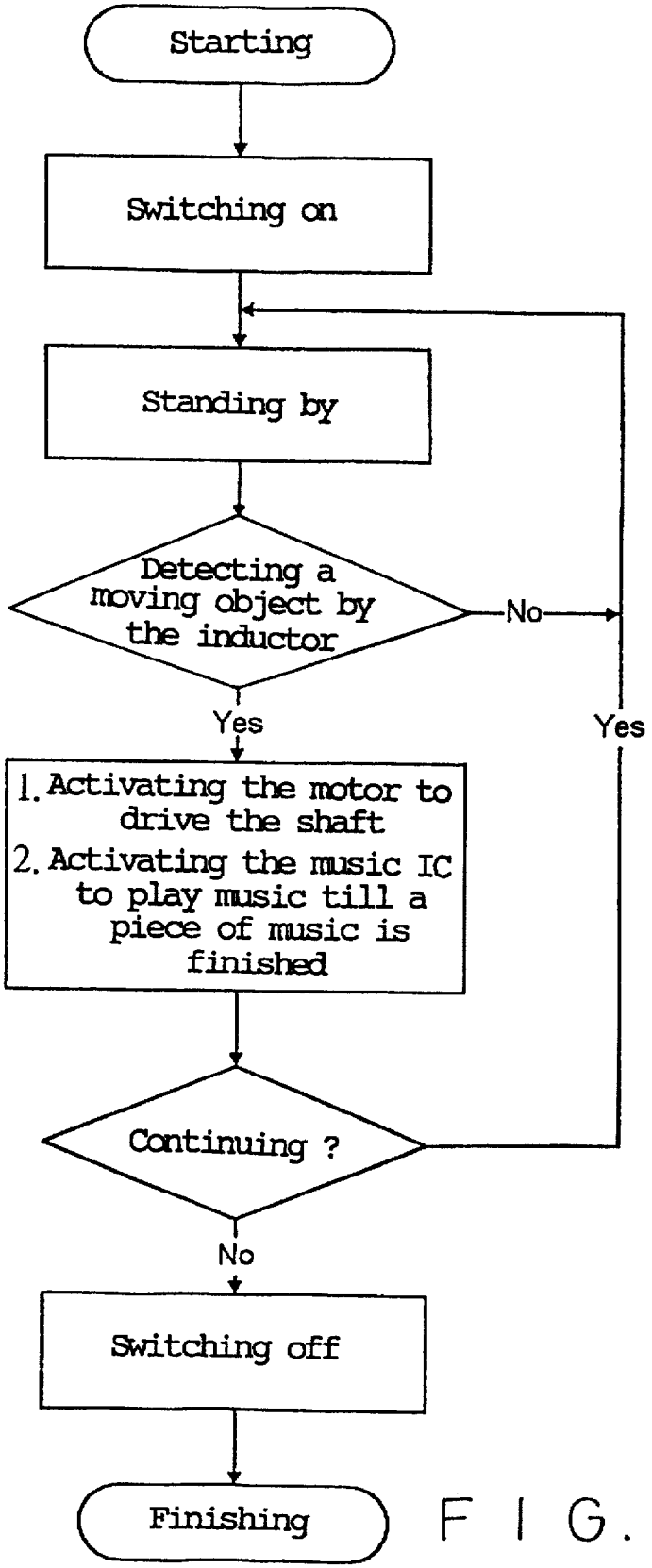
FIG. 3 is a flow chart of the present invention.

In use, referring to FIG. 2 and FIG. 3, the switch 16 is switched on, and all parts are connected to the power source and in readiness. When the user's hand is placed in front of the inductor 41, it sends out a signal to trigger the control circuit board 2 to activate the music IC 21 to smoothly play music through the horn 15. The motor 12, at the same time, is activated to drive the shaft 14 to rotate through the cluster gears 13. After the first musical tune is finished, the device will resume to the readiness state until the user's hand moves to the front of the inductor 41 again. In this way, the music can be replayed one by one. If the user wants to stop the music at any time, the switch 16 is just switched to the "OFF" position. In addition, the shaft 14 can drive several attaching shafts 14 at the same time by meshing with several cluster gears built up between the lid 5 and the locating cap piece 3. The attaching shafts 14 would extend out from the lid 5. In that arrangement, more varied dolls can be shown on a stage, on the top lid 5.

I claim:

1. A music box mechanism comprising:

a motor;

a control circuit board electrically coupled to said motor, said control circuit board including a music IC circuit having musical tunes prestored therein;

a stock supporting said control circuit board and said motor, said stock containing (a) a battery compartment electrically coupled to said control circuit board, (b) cluster gears coupled to said motor, (c) a vertically extending shaft pivotally supported by a bossing formed on said battery compartment and rotatably drivingly coupled to said cluster gears, (d) a switch electrically coupled to said control circuit board, (e) a horn electrically coupled to said control circuit board, and (f) a pair of spaced apart racks for holding said control circuit board therebetween;

a locating cap piece secured to a pair of screw bases formed on said battery compartment said locating cap piece having a centrally located through hole formed therein for passage of one end of said shaft therethrough;

a ring shell disposed on said stock and forming a cylindrical wall therefor;

an inductor disposed adjacent a top edge of said ring shell and electrically coupled to said control circuit board for initiating the output of a musical tune to said horn and operation of said motor responsive to said inductor detecting proximity of a user's hand thereto; and, a lid forming a cover for said ring shell secured to said stock, said lid having an opening formed centrally therethrough for passage of said one end of said shaft therethrough.

* * * * *